APPARATUS FOR ASSEMBLING A FRAME

BACKGROUND OF THE INVENTION

The present invention relates to an assembling apparatus, and more particularly to an apparatus for assembling a frame fabricated from magnetically attractable material which is initially in the form of a strip member.

There are many instances where it is necessary to form a frame from a strip member, such frames being used for boxes, pictures, molding and the like. This operation can be done by hand, and because of the particular nature of the frame, this operation usually is done by hand. However, such hand operation is both tedious and costly. Operations of this type, when carried out by hand, also cause excessive and early fatigue for the operator, and therefore increases the likelihood of industrial accidents and higher labor costs. It will be evident, that if means were provided for replacing the hand operation by an automatic device, assembly costs can be drastically reduced, and efficiency can be greatly increased.

SUMMARY OF THE INVENTION

The present invention, as will be described more fully hereinafter, provides automatic assembly apparatus for forming a frame from a strip material. The only manual operations involved with the present invention are the positioning of the strip material onto the apparatus, and the removal of the assembled frame therefrom, however this feeding and removal of the finish frame can be accomplished by automatic operations if desired.

Briefly, the present invention provides a base member, a first pair of arms pivotally mounted on the base member, and a second pair of arms pivotally secured to block members that are free to move relative to the base member. Each of the first pair of arms include magnetic means for holding the center portion of the strip for movement therewith. The block members are also provided with engagement means for pivoting the first pair of arms. Actuating means move the block members so that the engagement means pivot the first set of arms to form a first corner of the frame. After the first corner is formed, stop means stop the first set of arms in addition to stopping the block members, while the actuating means continue to move.

As the actuating means continue to move, turning means associated therewith turn the second pair of arms inwardly to enclose the frame structure. Preferably, one of the second pair of arms turns before the other arm so that one end portion of the strip is inserted into the other end portion of the strip for securement of the final corner. Additionally, one of the second pair of arms is provided with magnetic means to position a magnetically attractable member relative to the frame for movement therewith. Spring means are used to permit one member to be moved relative to another member when the other member is held stationary. Alignment means are provided to align the second pair of arms in their pivoted position to provide the final frame corner. Preferably, each of the pivot points is in alignment with an associated corner of the frame so that each of the arms moves an associated side of the frame without any movement therebetween.

Accordingly, it is an object of the present invention to provide an apparatus for assembling a frame from a strip material which overcomes the disadvantages of the prior art.

Another object of the present invention is to provide an apparatus as described above that is automatic in operation.

A further object of the present invention is to provide an apparatus as described above including magnetic means for holding the strip material in position for movement therewith.

A still further object of the present invention is to provide an apparatus as described above having two sets of pivoting arms for forming the frame structure.

Yet another object of the present invention is to provide an apparatus as described above that is low in cost, that requires a minimum of skill in its operation, and that is inherently safe to operate.

An added object of this invention is to provide an apparatus as described above that includes pivot points in alignment with the corners of the frame so that each of the arms moves an associated side of the frame without any movement therebetween, and that includes alignment means to compensate for any dimensional variations in the strip material when forming the final corner of the frame.

And yet another added object of the present invention is to provide an apparatus as described above that includes spring means to allow a first member to move together with a second member in addition to allowing the first member to move relative to the second member when the second member is stopped.

BRIEF DESCRIPTION OF THE DRAWINGS

With the above and additional objects and advantages in view, as will hereinafter appear, this invention comprises the devices, combinations and arrangtments of parts hereinafter described by way of example and illustrated in the accompanying drawings of a preferred embodiment in which:

FIGS. 4, 5 and 6 represent fragmented top plan views of various positions of the apparatus during the assembling of the frame;

FIG. 7 represents a perspective view of a box member formed by the apparatus from the elements shown in FIG. 3;

FIG. 11 represents an enlarged perspective view of the outer arm shown in FIG. 10.

DESCRIPTION OF THE PREFERRED EMBODIMENT

Figure 1:
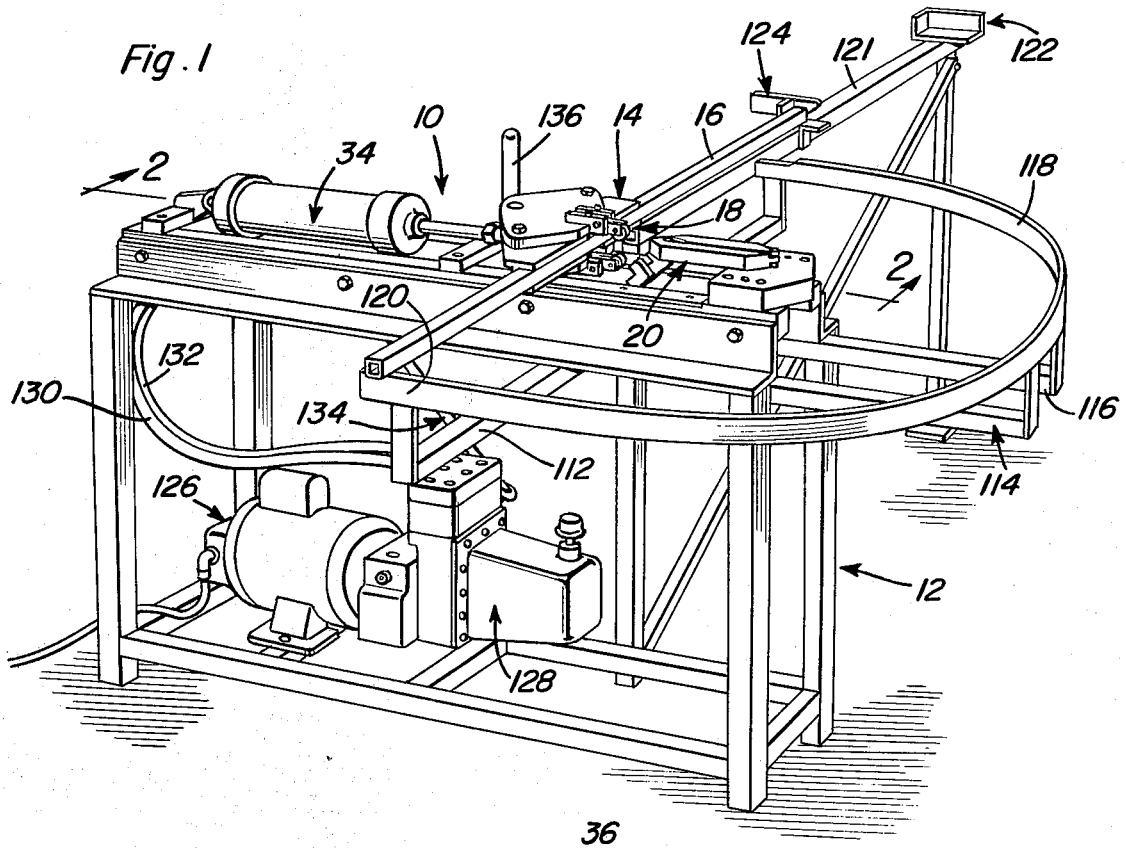
FIG. 1 represents a top plan view of an apparatus for assembling a frame pursuant to the present invention.

Referring to the drawings, FIG. 1 shows a top plan view of an apparatus 10 of the present invention for assembling a frame. The apparatus 10 includes a base member 12 having a raised platform 14 mounted thereon, being raised above the base member 12 by conventional posts 16 which are secured in a conventional manner between the platform 14 and the base member 12. The purpose of the platform 14 being

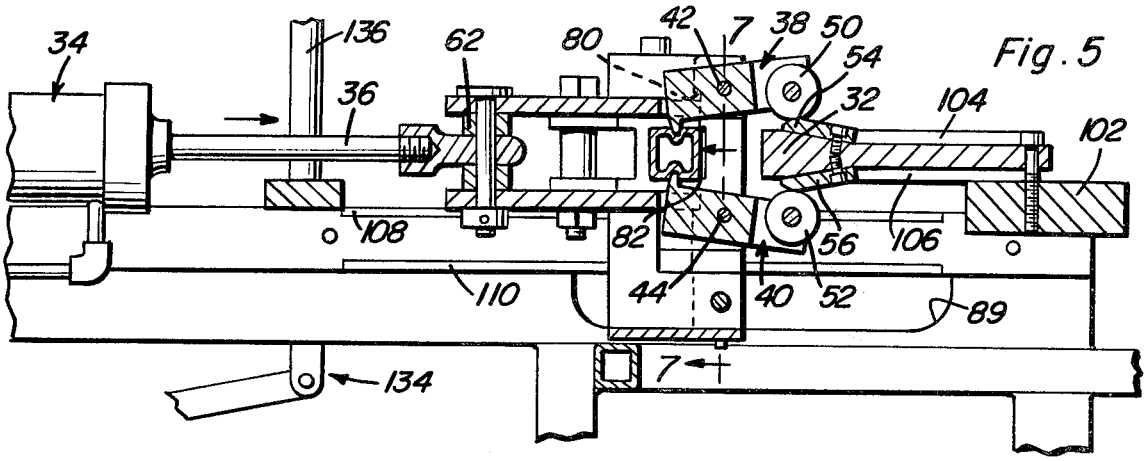
Fig. 5
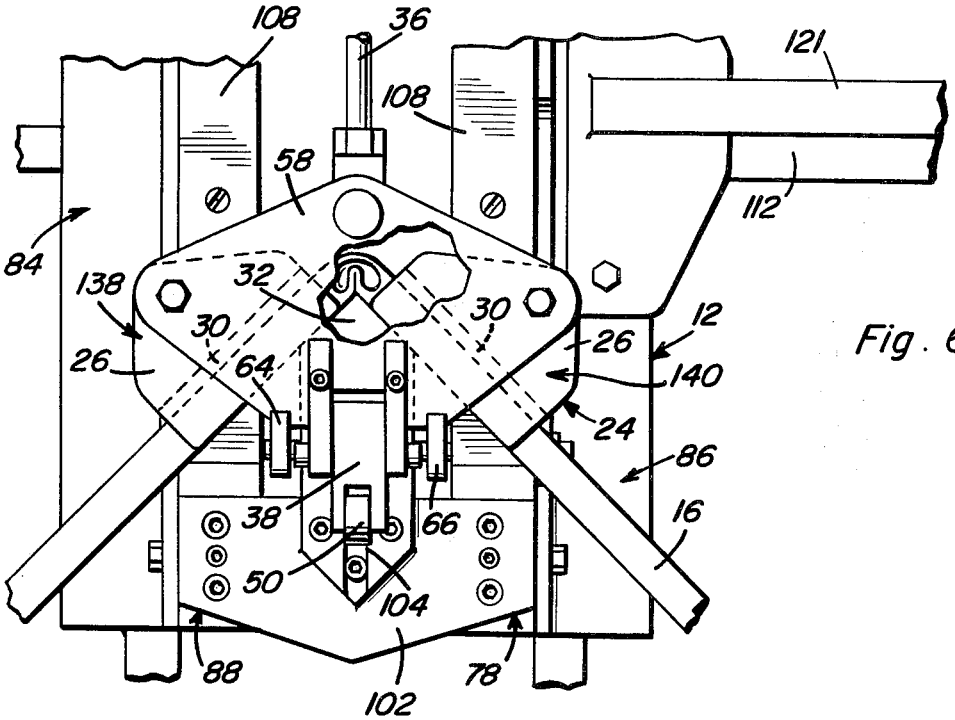
Fig. 6
Fig. 7
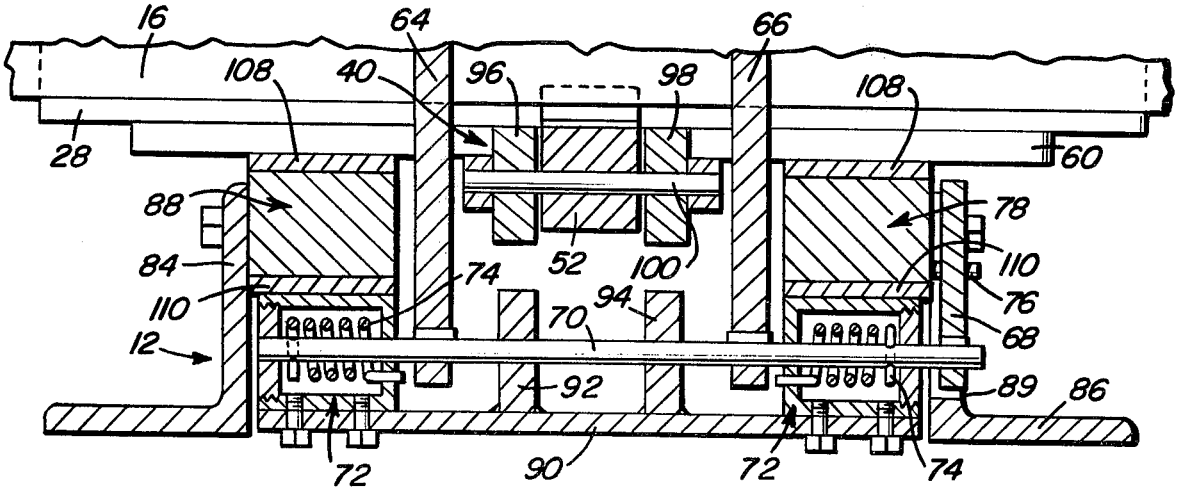

RECTANGULAR METAL-TUBING BENDER

BACKGROUND OF THE INVENTION

1. Field of the Invention

This invention is related generally to the bending of tubing, and particularly to the formation of bends in rectangular tubing, and the like, that are completely closed and square on the inside of the bend.

2. Description of the Prior Art

Conventional devices commonly employed for forming right-angle and similar bends in metal tubing having a rectangular cross section form an open bend which decreases the strength and rigidity of the element and makes it difficult to weld at the inside corner of the tube at the bend therein in order to additionally strengthen the bent tube.

Prior U.S. Pat. Nos. believed pertinent to this invention are as follows:

| | |
|---|---|
| 1,816,218 | July 28, 1931 |
| 2,148,748 | Feb. 28, 1939 |
| 2,516,372 | July 25, 1950 |
| 2,835,306 | May 20, 1958 |
| 3,042,099 | July 3, 1962 |
| 3,073,372 | Jan. 15, 1963 |
| 3,240,048 | Mar. 15, 1966 |
| 3,472,055 | Oct. 14, 1969 |

SUMMARY OF THE INVENTION

It is an object of the present invention to provide rectangular tubing with completely closed and square bends for forming a more rigid, stronger bend, and making it possible to weld the inside corner of the bend for additional strength.

It is another object of the present invention to provide for the bending of rectangular tubing, and the like, in a simple, efficient and consistent manner.

These and other objects are achieved according to the present invention by bends formed by first depressing, or dimpling, a section of a tube to be bent on two opposing sides thereof to form directly opposed dimples in the tube; then moving the dimpled tube toward a forming point; and bending the dimpled tube on the forming point.

Apparatus according to the present invention for forming the aforementioned bends includes: a frame; a holding arrangement for locking a rectangular tube to be bent in place on the frame; a squeezing arrangement for forming the depressions on opposite sides of the tube; and a forming member for bending the tube about the depressions formed therein.

The holding arrangement advantageously includes a carriage mounted on the frame for reciprocal movement with respect to the frame, and a support member mounted on the carriage. The support member includes a pair of substantially parallel, opposed, spaced flanges connected together by a web, with the flanges being arranged for receiving between them a tube to be bent.

The forming arrangement advantageously further includes a forming point member affixed to the frame and arranged for cooperating with the support member to bend a tube to be bent. Accordingly, the holding arrangement preferably further includes drive means for sequentially moving the carriage toward the forming point member.

A preferred embodiment of the squeezing arrangement includes a pair of rockers pivotally mounted about substantially parallel axes on the carriage whereby each rocker is provided with a pair of arms. A squeezing jaw is mounted on a one arm of a rocker, and a cam follower is mounted on the other of the arms. The jaws and cam followers of the rockers are arranged in opposed relationship to one another, and cams, which may be in the form of ramps mounted on the forming point member, operatively engage the cam followers and pivot the jaws towards one another for forming the depressions in the tube.

The holding arrangement preferably further includes a pair of plates arranged bracketing the support member, and a pair of lock arms are pivotally mounted on the carriage for selectively engaging the plates and preventing same from spreading apart as the cam followers contact the cam following ramps referred to above. In this manner, the tube being bent is securely held on the carriage as the various operations are being performed on the tube.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view showing a tubing bender according to the present invention.

Figure 2:
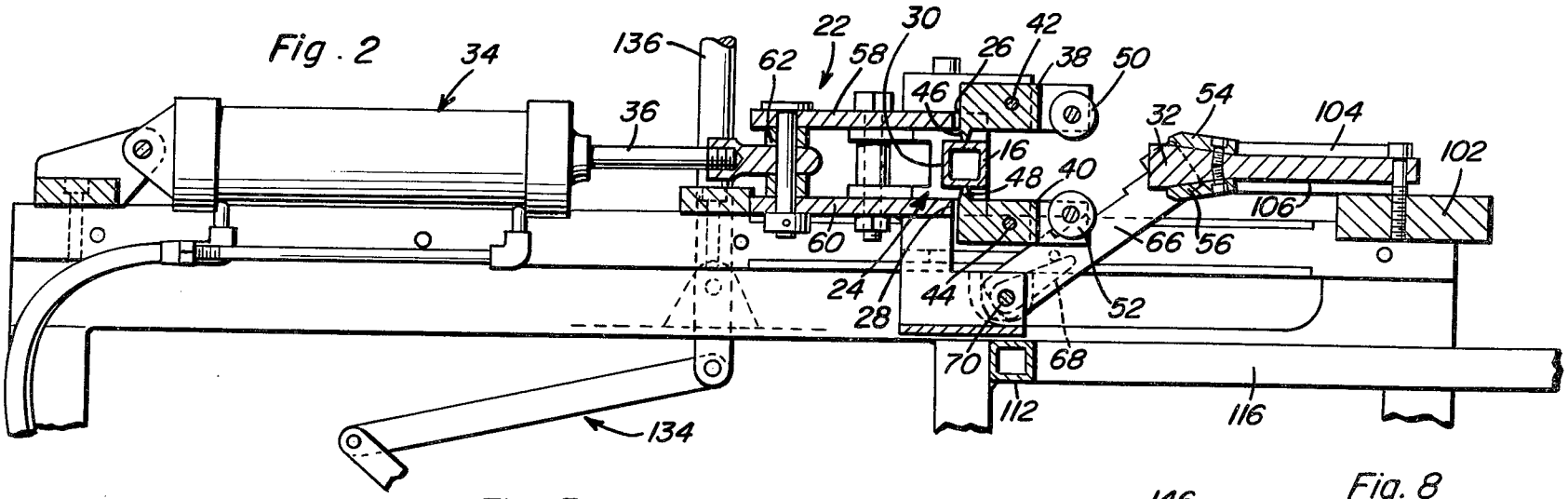
FIG. 2 represents an enlarged sectional view taken along line 2—2 of FIG. 1.

FIG. 2 is a fragmentary, sectional view taken generally along the line 2—2 of FIG. 1.

Figure 3:
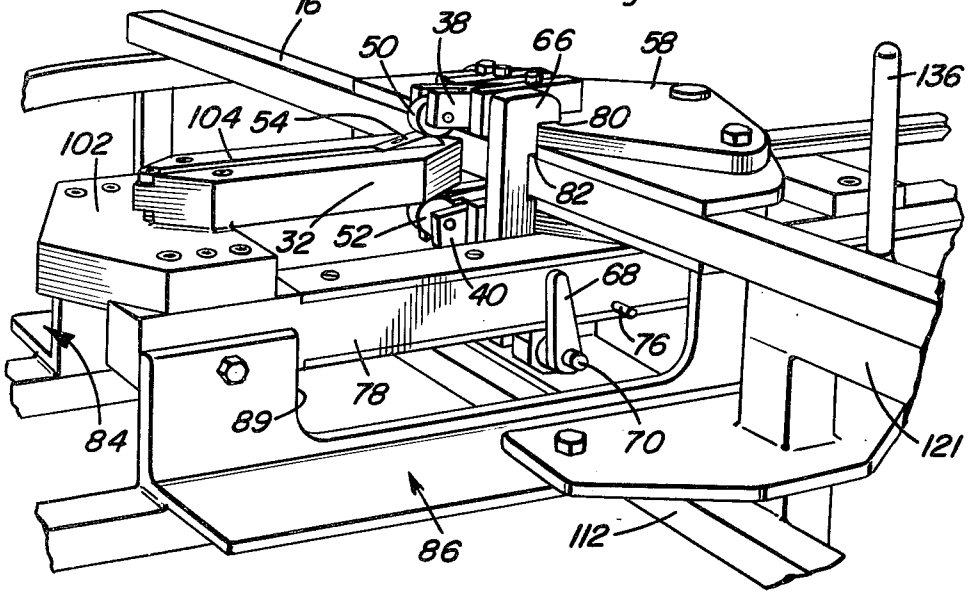
FIG. 3 represents an enlarged perspective view of the elements being assembled, including a strip member for forming the frame.

FIG. 3 is a fragmentary, perspective view showing a detail of the device of FIGS. 1 and 2.

Figure 4:
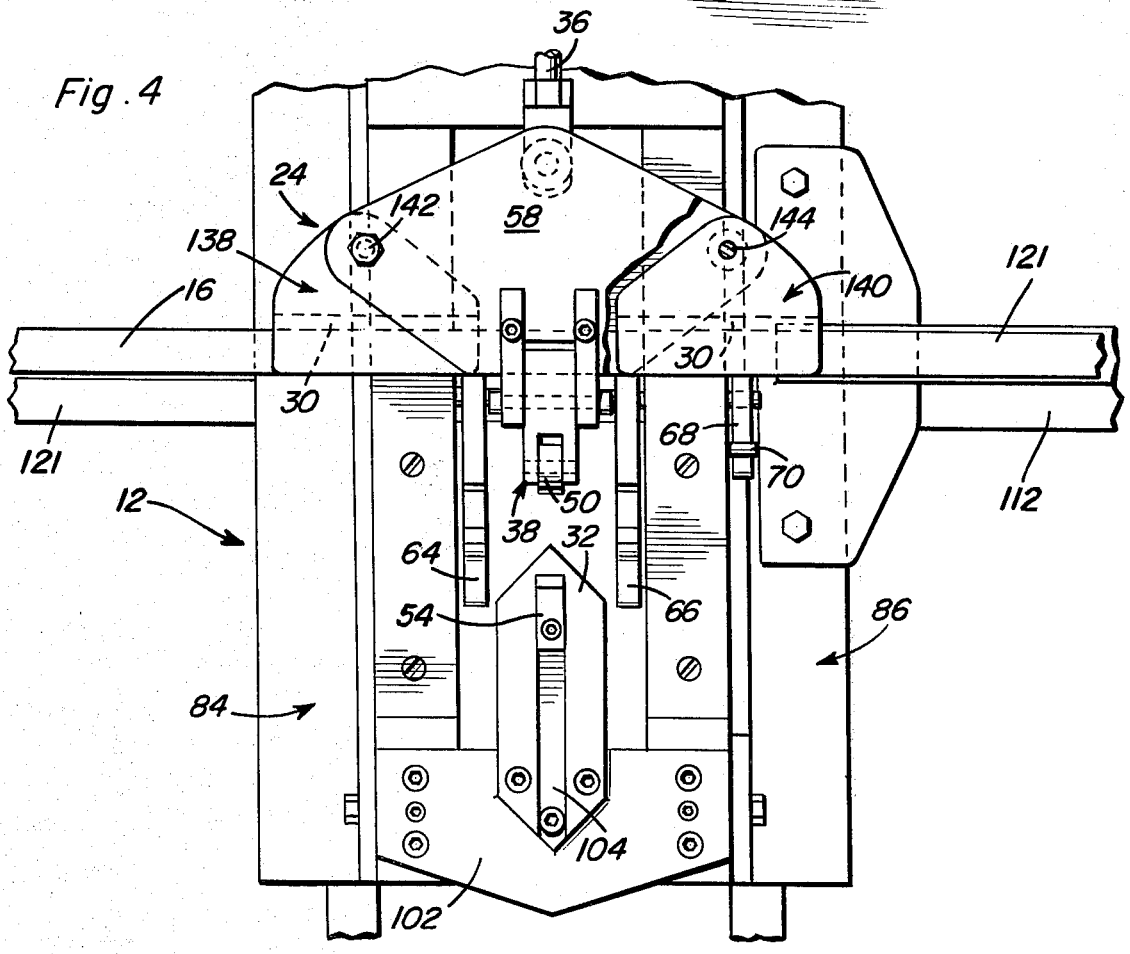

FIG. 4 is a fragmentary, top plan view showing the detail of FIG. 3, but with the parts thereof in a moved position.

FIG. 5 is a fragmentary, vertical, longitudinal sectional view, similar to FIG. 2, but showing certain parts in a moved position from FIG. 2.

FIG. 6 is a fragmentary, top plan view, partly broken away, similar to FIG. 4, but showing certain parts thereof in a moved position from their position in FIG. 4.

FIG. 7 is a fragmentary, sectional view taken generally along the line 7—7 in FIG. 5.

Figure 8:
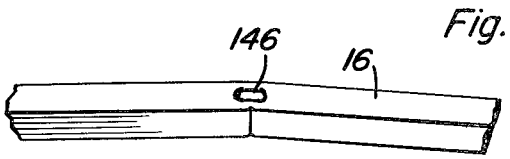
FIG. 8 represents a fragmented sectional view taken along the line 8—8 of FIG. 7.
Figure 9:
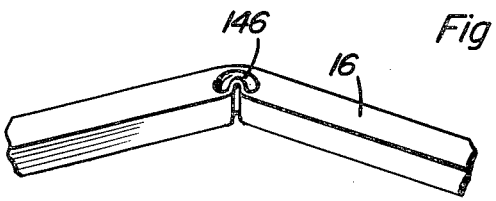
FIG. 9 represents a perspective view of the center arms of the apparatus.
Figure 10:
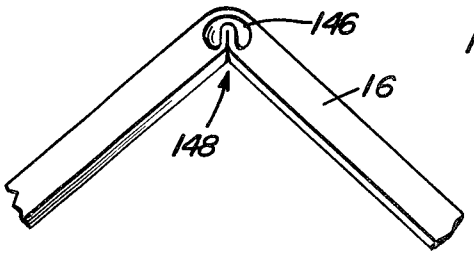
FIG. 10 represents a perspective view of an outer arm of the apparatus.

FIGS. 8, 9, and 10 are fragmentary, perspective views showing the sequence of steps in forming a bend in rectangular tubing in accordance with the present invention.

DESCRIPTION OF THE PREFERRED EMBODIMENTS

FIG. 1 of the drawings shows a rectangular tubing bender 10 according to the present invention which includes a frame 12 provided with an arrangement 14 for holding a tube 16 of rectangular cross section. A squeezing arrangement 18 is also provided on frame 12 for forming depressions, or dimples, on opposite sides of tube 16 prior to bending of the tube 16 by means of a forming arrangement 20. The tube is bent about the previously formed depressions in a manner to be described in greater detail below.

Referring now more particularly to FIGS. 2 through 4 of the drawings, arrangement 14 includes a carriage 22 slidably mounted on frame 12 for reciprocal movement with respect to the frame. A support member 24 is mounted on carriage 22, and includes a pair of substantially parallel, opposed, spaced flanges 26 and 28 connected together by a web 30. Flanges 26, 28 are arranged for receiving therebetween tube 16.

Arrangement 20 advantageously further includes a forming point member 32 affixed to frame 12 in a conventional manner and arranged for cooperating with support member 24 to bend tube 16. Toward this end, arrangement 14 further includes a drive motor 34, which is advantageously the illustrated linear fluid motor, connected to carriage 22 as by piston rod 36 for sequentially moving carriage 22 toward forming point member 32. As will be appreciated, motor 34 will also retract carriage 22 from the proximity of member 32.

Squeezing arrangement 18 advantageously includes a pair of rockers 38 and 40 pivotally mounted on carriage 22 for pivoting about suitable axles such as the illustrated pins 42 and 44. As can be readily appreciated from, for example, FIG. 2 of the drawings, rockers 38 and 40 are pivotally mounted on pins 42, 44 at points on the rockers between the ends of same for providing each rocker with a pair of arms. Squeezing jaws 46 and 48 are mounted on one arm of the rockers, while cam followers 50, 52 are mounted on the other arm of the rockers. Jaws 46, 48 and cam followers 50, 52 are arranged opposite one another for operatively engaging a pair of oppositely directed ramps affixed to the forming point member 32 and forming cams that pivot the jaws 46, 48 toward one another and cause them to form the depressions in tube 16.

Arrangement 14 still further includes a pair of plates 58 and 60, which may have the generally diamond-shaped configuration best seen perhaps in FIG. 4 of the drawings, arranged bracketing support member 24. The free end of piston rod 36 of motor 34 is pivotally connected to plates 58, 60 as by a conventional hinge 62. A pair of lock arms 64 and 66 are pivotally mounted on carriage 22 for selectively engaging plates 58 and 60 and preventing same from spreading apart as cam followers 50, 52 engage the cam forming ramps 54 and 56. A crank 68 is affixed to a shaft 70 to which arms 64 and 66 are also affixed. Shaft 70 is pivotally mounted in suitable brackets 72 as can be seen from FIG. 7 of the drawings. Coiled torsion springs 74 are associated with brackets 72 in a conventional manner for retaining arms 64 and 66 in their upright, or locking, position as shown in FIG. 3 of the drawings. A pin 76 is provided projecting from a beam 78 partially forming frame 12 for engaging crank 68 when carriage 22 is in a retracted position, as shown in FIGS. 2 and 4 of the drawings, and swinging arms 64 and 66 into the position shown in FIG. 2 for arm 66. This position is an inoperative position of the lock arms 64, 66 which permits the tube 16 to be removed from, and another tube placed into, support member 24. Notches 80 are provided in arms 64 and 66 for permitting the arms to positively engage plates 58 and 60 and prevent the plates from spreading. Further, notches 82 are provided in arms 64, 66 for mating with tubes 16 as can best be seen from FIG. 5 of the drawings.

Referring again to FIG. 7 of the drawings, frame 12 further includes a pair of angles 84 and 86 forming spaced, substantially parallel, side rails of the frame. Beam 78 and a similar beam 88 are attached to the respective angles 84 and 86. As can best be seen from FIG. 3, a cutout portion 89 is provided in angle 86 for receiving crank 68. A plate 90 is attached to brackets 72, which in turn slide beneath beams 78 and 88, and is provided with a pair of projections 92 and 94 which journal shaft 70. As also can best be seen from FIG. 7, rocker 40 is provided with a pair of spaced, substantially parallel portions 96 and 98 which receive cam follower 52. The latter is rotatably mounted on a rod 100 journaled in portions 96 and 98. It will be appreciated that rocker 38 is constructed in a similar manner.

Point member 32 is advantageously mounted in a conventional manner, such as by the illustrated bolt, to a crossbar 102 which is arranged extending between the beams 78 and 88. Grooves 104 and 106 are provided in point member 32 extending longitudinally away from the ramps 54 and 56 for forming a guide path for the cam followers 50, 52 and permitting the followers to move toward one another a distance sufficient to assure that the jaws 46 and 48 will clear tube 16 once the depressions have been made in the tube.

Guides 108 and 110, which are advantageously in the form of metal plates, and the like, are desirably provided in those portions of beams 78 and 88 traversed by carriage 22. In this manner, the lower surface of plate 60 and the uppermost portion of brackets 72 will act as slides which permit the carriage 22 to be moved in a rigid and stable manner along frame 12.

As best seen from FIGS. 1 and 3 of the drawings, an installation is provided which includes a crossbar 112 and beams 114 and 116 extending cantilever fashion perpendicular to bar 112 for supporting a curved rail 118 that prevents the tubing from dropping as the bend is being made. This also eliminates placing undue stress on the machine. Curved rail 118 has associated therewith a pair of guide bars 120 and 121 upon which the tube 60 is arranged prior to its being bent. A fixed stop 122 is arranged at the outermost end of guide bar 121, while an adjustable stop and alignment assembly 124 is provided for positioning tubing being bent to allow for varying placement of the bends. Assembly 124 is mounted on guide bar 121 in a manner that permits it to be adjusted along the length of the bar. This mounting may be achieved as by a conventional clamp mounting of the assembly, which mounting is shown schematically in FIG. 1.

Referring again to FIG. 1, a conventional electric motor 126, and the like, is connected to a conventional source of electric power (not shown) to actuate a conventional fluid pump 128. The output of pump 128 is situated through hoses 130 and 132 to motor 34 for the purpose of actuating same. A linkage 134 connects in a conventional manner an operator's handle 136 to the conventional control mechanism (not shown) of pump 128. In this manner, an operator (not shown) may actuate motor 34 by manipulation of handle 136 in a known manner.

As can best be seen from FIGS. 4 and 6 of the drawings, support member 24 is divided into a pair of similar portions 138 and 140. Each of these portions 138, 140 is pivotally mounted between plates 58 and 60 as by pins 142 and 144 which may be in the form of the illustrated bolts. Further, each of the portions 138 and 140 has a flange 26, 28 and a connecting web 30. Thus, when tube 16 is bent by engagement therewith against point member 32, portions 138 and 140 will be swung around pins 142 and 144 to a position forming a substantial V-shape as is shown in FIG. 6. When tube 16 is first placed within support member 24, however, the webs 30 will be parallel to tube 16 as is seen in FIG. 4.

OPERATION

The operation of a bender 10 according to the present invention will now be described with reference to FIGS. 5, 6, and 8 through 10 of the drawings.

A tube 16 is initially loaded into support member 24 with the carriage 22, and lock arms 64 and 66, in the positions shown in FIG. 2 of the drawings. Motor 34 is now actuated and carriage 22 is fed toward forming point member 32. When carriage 22 has traversed toward point member 32 sufficiently to permit the cam followers 50 and 52 to engage their associated ramps 54 and 56, as shown in FIG. 5, jaws 46 and 48 will be brought toward one another by a pivoting movement of rockers 38 and 40 about their associated pins 42 and 44, and a pair of directly opposed depressions 146 will be formed in opposite walls of tube 16. These depressions are advantageously substantially in the transverse center portion of the associated walls of the tube. As carriage 22 continues its movement to the right as seen in FIG. 5, cam followers 50 and 52 will fall into their associated grooves 104 and 106, an extreme position of which is shown in FIG. 6 of the drawings. When the cam followers 50, 52 pass into grooves 104, 106, carriage 22 will have moved sufficiently far to the right as viewed in FIG. 5 to cause the V-shaped point of forming point member 32 to engage tube 16 at a point immediately adjacent the depressions and in a wall adjacent the forming member 32 and perpendicular to the walls in which the depressions were made. It will be appreciated that once the cam followers 50, 52 pass into grooves 104, 106 jaws 46, 48 will be released from tube 16. Contact of tube 16 with forming point 32 will cause the tube to start to bend as is seen in FIG. 8. Continued movement of carriage 22 toward the right in FIG. 5 will cause additional bending of tube 16, as is shown in, for example, FIG. 9. Both depressed sides of tube 16 bend inward as the bending proceeds. Further, the area where the forming point member 32 contacts tubing 16 also bends inwardly. This is apparent from FIG. 9. As tube 16 is bent further, the bend on the inside of the tubing forces forming point member 32 out of the inside bend, thus allowing completion of the bend as shown in FIGS. 6 and 10 of the drawings. In this manner, a bend is formed which is closed and square on the inside 148 of the bend, thus making it possible to weld the inside corner of the bend for additional strength.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. A rectangular tubing bender, comprising, in combination:

a. a frame;

b. holding means for locking a rectangular tube to be bent in place on the frame;

c. squeezing means for forming depressions on opposite sides of the tube;

d. forming means for bending the tube into a closed corner about the depressions therein; and the holding means (b) includes a carriage mounted on the frame for reciprocal movement with respect to the frame, and a support member mounted on the carriage, the support member including a pair of pivotally mounted portions, each portion including a pair of substantially parallel, opposed, spaced flanges connected together by a web, the flanges being arranged for receiving therebetween a tube to be bent, and the web being arranged for forming substantially a V-shape to conform to the tube as same is being bent by the forming means; and the forming means (d) further includes a forming point member affixed to the frame and arranged for cooperating with the support member to bend a tube to be bent, and the holding means (b) further including drive means for sequentially moving the carriage toward the forming point member; and the squeezing means (c) includes a pair of rockers pivotally mounted on the carriage about substantially parallel axes arranged between ends of the rockers for providing each rocker with a pair of arms, a squeezing jaw mounted on one arm and a cam follower mounted on the other arm, the jaws, and cam followers, arranged opposite one another, and cam means mounted on the frame for operatively engaging the cam followers and pivoting the jaws toward one another and forming depressions in the tube.

2. A structure as defined in claim 1, wherein the cam means includes a pair of oppositely directed ramps affixed to the forming point member.

3. A structure as defined in claim 2, wherein the holding means further includes a pair of plates arranged bracketing the support member, fastener means for pivotally connecting the plates to one another and to the piston rod, and a pair of lock arms pivotally mounted on the carriage for selectively engaging the plates and preventing same from spreading apart as the cam followers engage the cam forming ramps.

4. A structure as defined in claim 3, wherein the drive means includes a linear fluid motor having a piston rod connected directly to the carriage.

5. A rectangular tubing bender, comprising, in combination;

a. a frame;

b. holding means for locking a rectangular tube to be bent in place on the frame;

c. squeezing means for forming depressions on opposite sides of the tube; the squeezing means includes a pair of rockers pivotally mounted about substantially parallel axes arranged between ends of the rockers for providing each rocker with a pair of arms, a squeezing jaw mounted on one arm and a cam follower mounted on the other arm, the jaws, and cam followers, arranged opposite one another, and cam means mounted on the frame for oppositely engaging the cam followers and pivoting the jaws toward one another and forming depressions in the tube;

d. forming means for bending the tube into a closed corner about the depressions therein; and the holding means (b) includes a carriage mounted on the frame for reciprocal movement with respect to the frame, and a support member mounted on the carriage, the support member including a pair of pivotally mounted portions, each portion including a pair of substantially parallel, opposed, spaced flanges connected together by a web, the flanges being arranged for receiving therebetween a tube to be bent, and the web being arranged for forming substantially a V-shape to conform to the tube as same is being bent by the forming means; and the holding means further includes a pair of plates arranged bracketing the support member, fastener means for pivotally connecting the plates to one another and to the piston rod, and a pair of lock arms pivotally mounted on the carriage for selectively engaging the plates and preventing same from spreading apart as the cam followers engage the cam forming ramps.

6. A rectangular tubing bender, comprising, in combination;

a. a frame;

b. holding means for locking a rectangular tube to be bent in place on the frame;

c. squeezing means for forming depressions on opposite sides of the tube;

d. forming means for bending the tube into a closed corner about the depressions therein; and the squeezing means (c) includes a pair of rockers pivotally mounted about substantially parallel axes arranged between ends of the rockers for providing each rocker with a pair of arms, a squeezing jaw mounted on one arms and a cam follower mounted on the other arm, the jaws, and cam followers, arranged opposite one another, and cam means mounted on the frame for oppositely engaging the cam followers and pivoting the jaws toward one another and forming depressions in the tube.

7. A structure as defined in claim 5, wherein the cam means includes a pair of oppositely directed ramps affixed to a forming point member of said forming means.

* * * * *